US009601088B2

(12) United States Patent
Hashimoto

(10) Patent No.: US 9,601,088 B2
(45) Date of Patent: Mar. 21, 2017

(54) DISPLAY DEVICES AND DRIVING CIRCUIT

(71) Applicant: InnoLux Corporation, Miao-Li County (TW)

(72) Inventor: Kazuyuki Hashimoto, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 0 days.

(21) Appl. No.: 14/467,130

(22) Filed: Aug. 25, 2014

(65) Prior Publication Data

US 2016/0055828 A1 Feb. 25, 2016

(51) Int. Cl.
*G09G 5/18* (2006.01)
*G09G 3/32* (2016.01)

(52) U.S. Cl.
CPC ..... *G09G 5/18* (2013.01); *G09G 3/3208* (2013.01); *G09G 2330/028* (2013.01)

(58) Field of Classification Search
CPC ... G09G 5/18; G09G 3/3208; G09G 2330/028
See application file for complete search history.

(56) References Cited

U.S. PATENT DOCUMENTS

2006/0244499 A1 11/2006 Miyata et al.
2009/0009497 A1* 1/2009 Lee ..... G09G 3/3674 345/205
2011/0285697 A1* 11/2011 Lee ..... G06F 1/324 345/419

FOREIGN PATENT DOCUMENTS

TW 200421712 10/2004

OTHER PUBLICATIONS

Chinese language office action dated May 16, 2016, issued in application No. TW 104124676.

* cited by examiner

*Primary Examiner* — Premal Patel
(74) *Attorney, Agent, or Firm* — McClure, Qualey & Rodack, LLP

(57) ABSTRACT

A display device includes a controller chip and a storage circuit. The controller chip includes a clock generating circuit configured to generate a clock signal. The storage circuit is coupled to the clock generating circuit and includes a first electronic component. In a falling edge of the clock signal, a voltage of the clock signal falls in multiple steps from a system high voltage to a first target voltage and then to a system low voltage, and in a rising edge of the clock signal, the voltage of the clock signal rises in multiple steps from the system low voltage to the first target voltage and then to the system high voltage.

14 Claims, 13 Drawing Sheets

DISPLAY DEVICES AND DRIVING CIRCUIT

BACKGROUND OF THE INVENTION

Field of the Invention

The invention relates to a display device and a driving circuit, and more particularly to a display device and a driving circuit having a clock generating circuit that consumes less power when generating the clock signal.

Description of the Related Art

Organic light emitting diode (OLED) displays that use organic compounds as a lighting material for illumination are one type of flat displays. The advantages of the OLED displays are that they are a smaller size, lighter in weight, have a wider viewing angle, and have a higher contrast ratio and a faster speed.

Active matrix organic light emitting diode (AMOLED) displays are currently emerging as the next generation of flat panel displays. Compared with active matrix liquid crystal displays (AMLCD), the AMOLED display has many advantages, such as is higher contrast ratio, wider viewing angle, and thinner module without a backlight, lower power consumption, and lower cost.

A clock signal is a very important timing control signal in display devices, no matter whether the display devices are traditional LCD, OLED, or the recently developed AMLCD, AMOLED, or other types of display devices. Therefore, how to reduce power consumption in generating the clock signal is an issue worthy of concern.

BRIEF SUMMARY OF THE INVENTION

Display devices and driving circuits are provided. An exemplary embodiment of a display device comprises a controller chip and a storage circuit. The controller chip comprises a clock generating circuit configured to generate a clock signal. The storage circuit is coupled to the clock generating circuit and comprises a first electronic component. In a falling edge of the clock signal, a voltage of the clock signal falls in multiple steps from a system high voltage to a first target voltage and then to a system low voltage, and in a rising edge of the clock signal, the voltage of the clock signal rises in multiple steps from the system low voltage to the first target voltage and then to the system high voltage.

Another exemplary embodiment of a driving circuit comprises a clock generating circuit configured to generate a clock signal and a first capacitor coupled to the clock generating circuit. In a falling edge of the clock signal, a voltage of the clock signal falls in multiple steps from a system high voltage to a first target voltage and then to a system low voltage, and in a rising edge of the clock signal, the voltage of the clock signal rises in multiple steps from the system low voltage to the first target voltage and then to the system high voltage.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
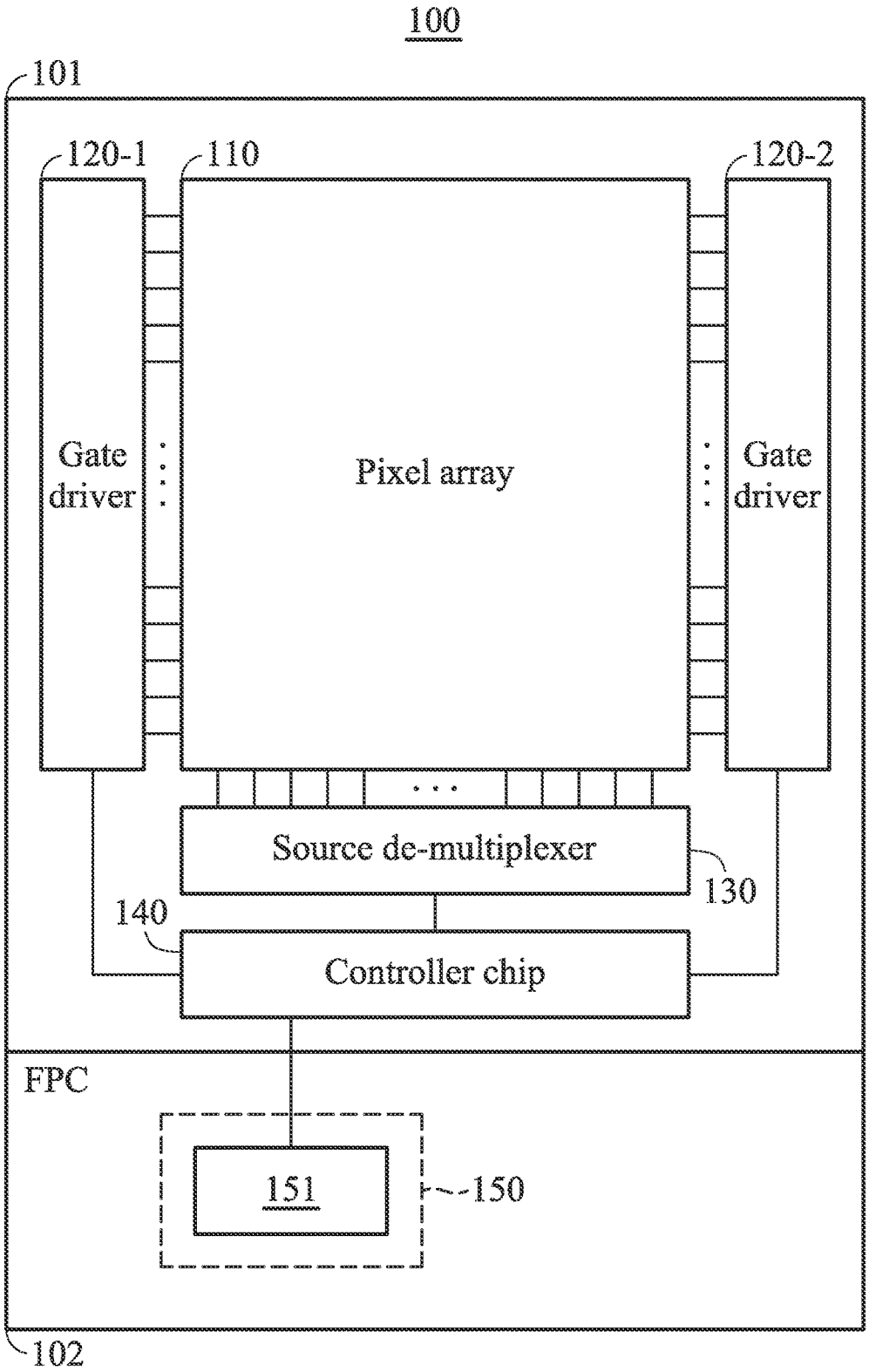
FIG. 1 is a block diagram of a display device according to an embodiment of the invention.

FIG. 1 is a block diagram of a display device according to an embodiment of the invention. The display device 100 may comprise a display panel 101 and a flexible printed circuit (FPC) 102 coupled to the display panel 101. The display panel 101 may comprise a pixel array 110, gate drivers 120-1 and 120-2, a source de-multiplexer 130 and a controller chip 140. The gate drivers 120-1 and 120-2 generate a plurality of gate driving signals to drive a plurality of pixels in the pixel array 110. The source de-multiplexer 130 receives a plurality of data driving signals from a source driver (not shown) to de-multiplex the data driving signals to the pixels of the pixel array 110. The controller chip 140 is a driver IC and comprises at least a timing controller and a clock generating circuit configured to generate a plurality of control signals and timing signals, such as a clock signal. The controller chip 140 may further be coupled to a host controller (not shown) of an electronic device comprising the display device 100 and communicate with the host controller.

The FPC 102 may comprise a plurality of circuits and traces which are preferably configured outside of the display panel 101, so as to reduce the size of the display panel 101. For example, in an embodiment of the invention, the FPC 102 may comprise a storage circuit 150 coupled to the controller chip 140 and comprising at least one electronic component 151 configured to reduce power consumption of the clock generating circuit of the controller chip 140.

Figure 2:
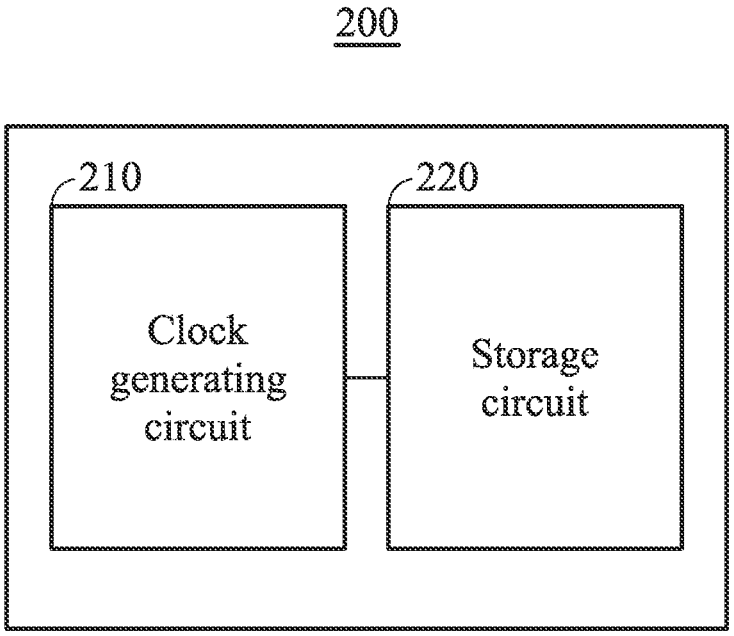
FIG. 2 is a block diagram of a driving circuit according to an embodiment of the invention.

FIG. 2 is a block diagram of a driving circuit according to an embodiment of the invention. The driving circuit 200 may comprise at least a clock generating circuit 210 configured to generate a clock signal and a storage circuit 220 coupled to the clock generating circuit 210 and comprising one or more electronic components to reduce power consumption of the clock generating circuit. According to the embodiment of the invention, the clock generating circuit 210 of the driving circuit 200 may be implemented in a controller chip (driver IC) of a display device, but it is not limited thereto. To be more specific, the driving circuit 200 may be implemented in any electronic device with or without display functionality to provide clock signal(s) to one or more hardware device of the corresponding electronic device. For example, the driving circuit 200 may be implemented in a touch sensor of a touch panel or a touch pad for providing clock signals to the transmitting electrodes for sensing touch events on the touch panel or touch pad.

Figure 3:
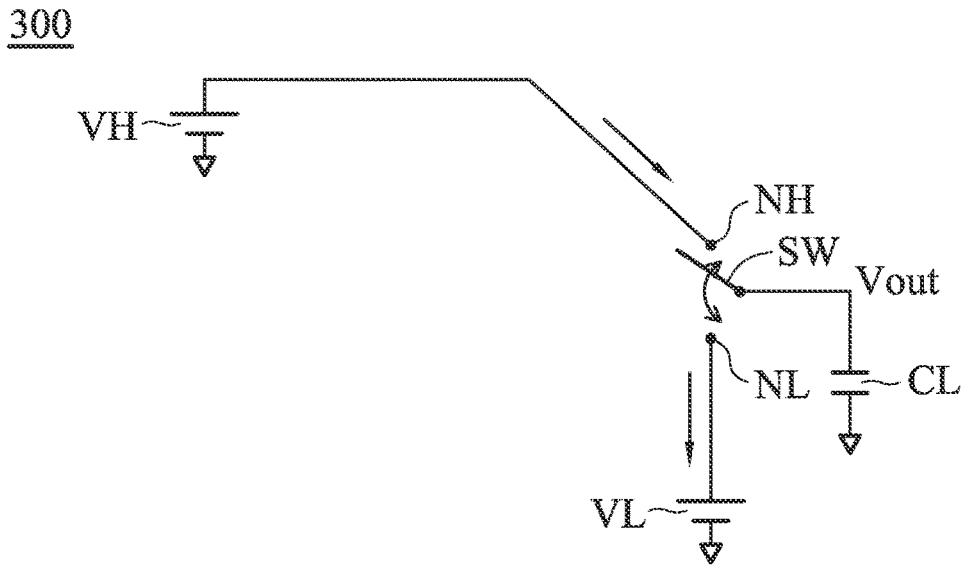
FIG. 3 shows a circuit diagram of an exemplary clock generating circuit.

FIG. 3 shows a circuit diagram of an exemplary clock generating circuit. The clock generating circuit 300 comprises a switch SW having one terminal coupled to an output node Vout for outputting the clock signal and another terminal selectively coupled to a high voltage node NH for providing the system high voltage VH and a low voltage node NL for providing the system low voltage VL. A capacitive loading CL coupled to the output node Vout represents the loading of a device receiving the clock signal. For example, the capacitive loading CL may represent the capacitive loading of a gate driver, a source de-multiplexer, or others. When the switch SW is controlled (for example, by a timing controller in the controller chip 140) to be coupled to the high voltage node NH, the capacitive loading CL is charged by the system high voltage VH. When the switch SW is controlled to be coupled to the low voltage node NL, the capacitive loading CL is discharged by the system low voltage VL. By controlling the switch SW to switch between the high voltage node NH and the low voltage node NL in a cyclic manner, a clock signal is generated at the output node Vout.

Figure 4:
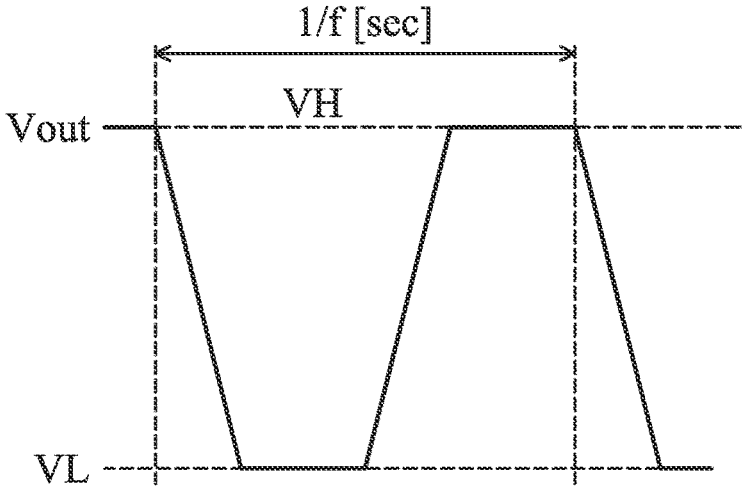
FIG. 4 shows an exemplary waveform of a clock signal.

FIG. 4 shows an exemplary waveform of a clock signal generated by the clock generating circuit 300 as shown in FIG. 3. The clock signal has a frequency f(Hz) as shown in FIG. 4. The power consumption P(Walt) of the clock generating circuit 300 is a function of capacitive loading CL, applied voltages VH and VL and frequency f as derived below;

$$P=VH*CL*(VH-VL)*f+VL*CL*(VL-VH)*f=CL*(VH-VL)^2*f \quad \text{Eq.(1)}$$

In the embodiments of the invention, to reduce the power consumed by the clock generating circuit when generating the clock signal, one or more electronic components may be introduced to facilitate charge-recycle.

Figure 5:
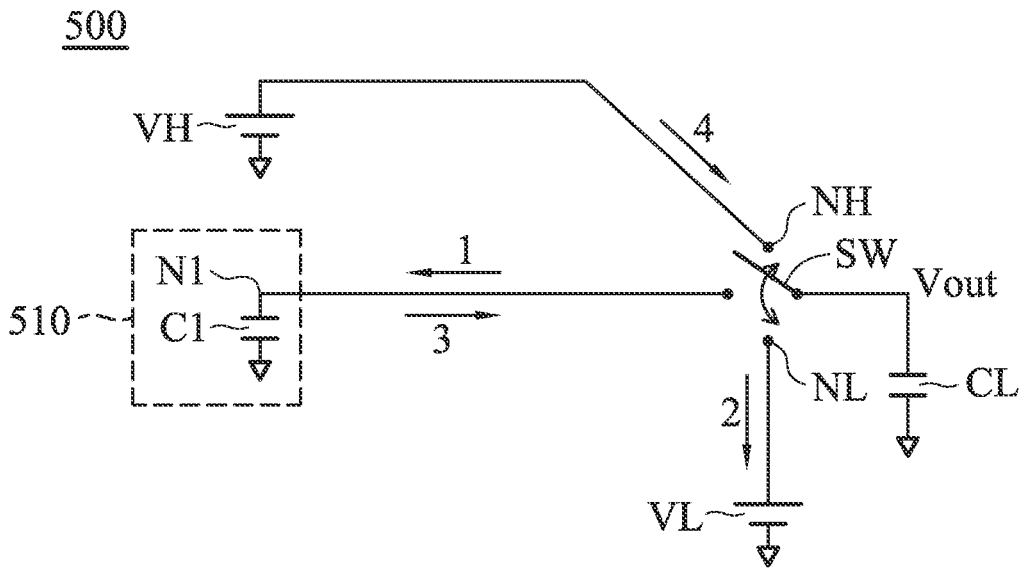
FIG. 5 shows a circuit diagram of an exemplary driving circuit according to an embodiment of the invention.

FIG. 5 shows a circuit diagram of an exemplary driving circuit according to an embodiment of the invention. The driving circuit 500 may comprise a clock generating circuit as shown in FIG. 3 and a storage circuit 510 coupled to the clock generating circuit and configured to reduce the power consumption of the clock generating circuit. The storage circuit 510 may comprise a capacitor C1 for charge-recycle.

The switch SW has one terminal coupled to an output node Vout for outputting the clock signal and another terminal selectively coupled to a high voltage node NH for providing the system high voltage VH, a low voltage node NL for providing the system low voltage VL and a node N1 coupled to the capacitor C1. The timing of controlling the switch SW is illustrated as the number shown in FIG. 5. By controlling the switch SW to switch between these nodes by turns as the number shown in FIG. 5, the capacitive loading CL is discharged and charged in multiple steps.

Figure 6:
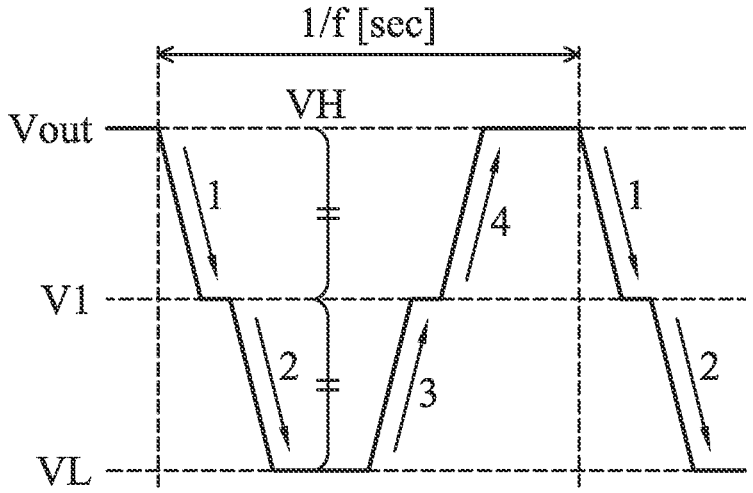
FIG. 6 shows an exemplary waveform of a clock signal generated by the driving circuit as shown in FIG. 5 according to an embodiment of the invention.

FIG. 6 shows an exemplary waveform of a clock signal generated by the driving circuit 500 as shown in FIG. 5 according to an embodiment of the invention. In the first step (step 1), the switch SW is coupled to the node N1 to discharge the capacitive loading CL, and the charges discharged from the capacitive loading CL are stored to the capacitor C1. In the second step (step 2), the switch SW is coupled to the low voltage node NL to further discharge the capacitive loading CL via the system low voltage VL. In the third step (step 3), the switch SW is coupled to the node N1, and the charges stored in the capacitor C1 are discharged and recycled to charge the capacitive loading CL. In the fourth step (step 4), the switch SW is coupled to the high voltage node NH to further charge the capacitive loading CL via the system high voltage VH. In this manner, as shown in FIG. 6, in a falling edge of the clock signal, a voltage of the clock signal falls in two steps from the system high voltage VH to a first target voltage V1 then to the system low voltage VL, and in a rising edge of the clock signal, the voltage of the clock signal rises in two steps from the system low voltage VL to the first target voltage V1 then to the system high voltage VH. According to an embodiment of the invention, the first target voltage V1 relates to a characteristic of the capacitor C1 (which will be further discussed in the following paragraphs). Ideally, V1=(VH−VL)/2.

Note that, in some embodiments of the invention, the voltage of the clock signal may stay at the first target voltage V1 for a while to form voltage plateaus in the rising and falling edge of the clock signal. However, in other embodiments of the invention, the time for the voltage to stay at the first target voltage V1 may be very short or even approach zero. Therefore, the invention should not be limited to either case.

In addition, in the preferred embodiments of the invention, the slopes of the clock signal in the two steps of discharge and the two steps of charge are preferably the same. However, the slope of the clock signal in the first step of discharging (step 1) may be the same as or different from the slope of the clock signal in the second step of discharging (step 2), and the slope of the clock signal in the first step of charging (step 3) may be the same or different to the slope of the clock signal in the second step of charging (step 4). Similarly, the slope of the clock signal in the first step of discharging (step 1) may be the same or different to the slope of the clock signal in the second step of charging (step 4), and the slope of the clock signal in the second step of discharging (step 2) may be the same or different to the slope of the clock signal in the first step of charging (step 3). Therefore, the invention should not be limited to either case.

By introducing a storage capacitor C1 to the clock generating circuit as shown in FIG. 5 and the corresponding control scheme, the power consumption of the clock generating circuit is derived as below:

$$P=VH*CL*(VH-VL)/2*f+VL*CL*(VL-VH)/2*f=CL*(VH-VL)^2*f/2 \quad \text{Eq.(2)}$$

Since the charges stored in the capacitor C1 are recycled, there is no power consumption in the first step of discharging (step 1) and the in the first step of charging (step 3). Therefore, the power derived in Eq.(2) is reduced to 50% of the power derived in Eq. (1).

Figure 7:
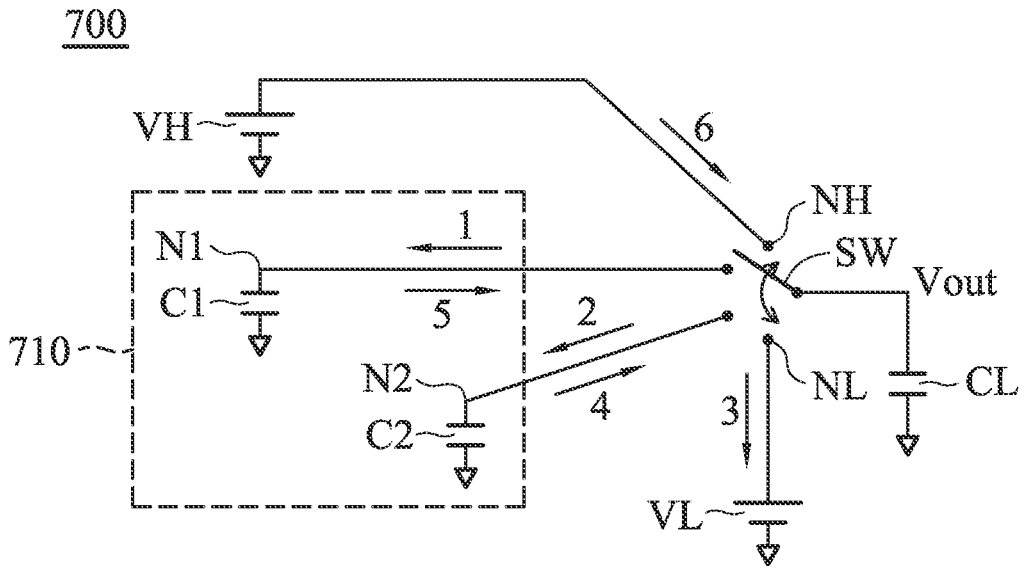
FIG. 7 shows a circuit diagram of another exemplary driving circuit according to another embodiment of the invention.

FIG. 7 shows a circuit diagram of another exemplary driving circuit according to another embodiment of the invention. The driving circuit 700 may comprise a clock generating circuit as shown in FIG. 3 and a storage circuit 710 coupled to the clock generating circuit and configured to reduce the power consumption of the clock generating circuit. The storage circuit 710 may comprise capacitors C1 and C2 for charge-recycle.

The switch SW has one terminal coupled to an output node Vout for outputting the clock signal and another terminal selectively coupled to a high voltage node NH for providing the system high voltage VH, a low voltage node NL for providing the system low voltage VL, a node N1 coupled to the capacitor C1 and a node N2 coupled to the capacitor C2. The timing of controlling the switch SW is illustrated as the number shown in FIG. 7. By controlling the switch SW to switch between these nodes by turns as the number shown in FIG. 7, the capacitive loading CL is discharged and charged in multiple steps.

Figure 8:
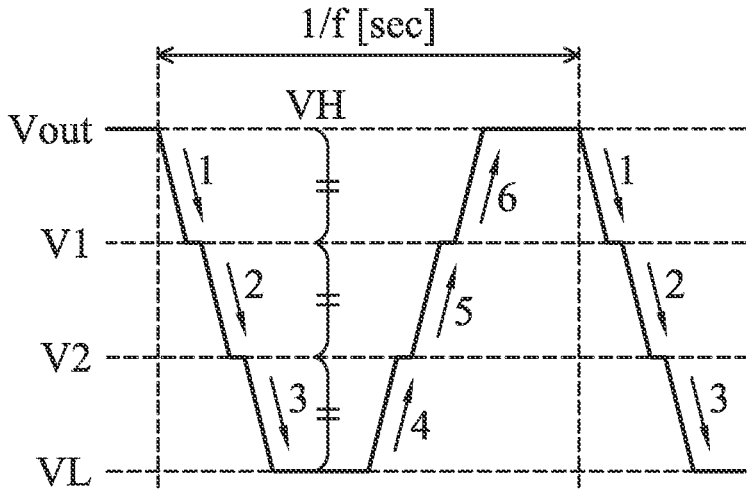
FIG. 8 shows an exemplary waveform of a clock signal generated by the driving circuit as shown in FIG. 7 according to an embodiment of the invention.

FIG. 8 shows an exemplary waveform of a clock signal generated by the driving circuit 700 as shown in FIG. 7 according to an embodiment of the invention. In the first step (step 1), the switch SW is coupled to the node N1 to discharge the capacitive loading CL, and the charges discharged from the capacitive loading CL are stored to the capacitor C1. In the second step (step 2), the switch SW is coupled to the node N2 to discharge the capacitive loading CL, and the charges discharged from the capacitive loading CL are stored to the capacitor C2. In the third step (step 3), the switch SW is coupled to the low voltage node NL to further discharge the capacitive loading CL via the system low voltage VL.

In the fourth step (step 4), the switch SW is coupled to the node N2, and the charges stored in the capacitor C2 are discharged and recycled to charge the capacitive loading CL. In the fifth step (step 5), the switch SW is coupled to the node N1, and the charges stored in the capacitor C1 are discharged and recycled to charge the capacitive loading CL. In the sixth step (step 6), the switch SW is coupled to the high voltage node NH to further charge the capacitive loading CL via the system high voltage VH. In this manner, as shown in FIG. 8, in a falling edge of the clock signal, a voltage of the clock signal falls in three steps from the system high voltage VH to a first target voltage V1, a second target voltage V2, and then to the system low voltage VL, and in a rising edge of the clock signal, the voltage of the clock signal rises in three steps from the system low voltage VL to the second target voltage V2, the first target voltage V1, and then to the system high voltage VH. According to an embodiment of the invention, the first target voltage V1 relates to a characteristic of the capacitor C1 and the second target voltage V2 relates to a characteristic of the capacitor C2 (which will be further discussed in the following paragraphs). Ideally, V1=2*(VH−VL)/3 and V2=(VH−VL)/3.

Note that in some embodiments of the invention, the voltage of the clock signal may stay at the first target voltage V1 and the second target voltage V2 for a while to form voltage plateaus in the rising and falling edge of the clock signal. However, in other embodiments of the invention, the time for the voltage to stay at the first target voltage V1 and/or the second target voltage V2 may be very short or even approach zero. Therefore, the invention should not be limited either case.

In addition, in the preferred embodiments of the invention, the slopes of the clock signal in the three steps of discharge and the three steps of charge are preferably the same. However, the slope of the clock signal in the first step of discharging (step 1) may be the same or different to the slope of the clock signal in the second step of discharging (step 2), and the slope of the clock signal in the second step of discharging (step 2) may be the same or different to the slope of the clock signal in the third step of discharging (step 3). In addition, the slope of the clock signal in the first step of charging (step 4) may be the same or different to the slope of the clock signal in the second step of charging (step 5), and slope of the clock signal in the second step of charging (step 5) may be the same or different to the slope of the clock signal in the third step of charging (step 6). Therefore, the invention should not be limited either case.

Similarly, the slope of the clock signal in the first step of discharging (step 1) may be the same or different to the slope of the clock signal in the third step of charging (step 6), the slope of the clock signal in the second step of discharging (step 2) may be the same or different to the slope of the clock signal in the second step of charging (step 5), and the slope of the clock signal in the third step of discharging (step 3) may be the same or different to the slope of the clock signal in the first step of charging (step 4). Therefore, the invention should not be limited either case.

By introducing the storage capacitors C1 and C2 to the clock generating circuit as shown in FIG. 7 and the corresponding control scheme, the power consumption of the clock generating circuit is derived as below:

$$P=VH*CL*(VH-VL)/3*f+VL*CL*(VL-VH)/3*f=CL*(VH-VL)^2*f/3 \quad \text{Eq.(3)}$$

Since the charges stored in the capacitors C1 and C2 are recycled, there is no power consumption in the first and second steps of discharging (steps 1 and 2) and no power consumption in the first and second steps of charging (steps 4 and 5). Therefore, the power derived in Eq.(3) is reduced to as 33.3% of the power derived in Eq. (1).

While the embodiments have been described by way of various capacitor examples, it is to be understood that the invention is not limited to FIG. 5-FIG. 7. On the contrary, it is intended to cover various modifications and similar arrangements. For example, the storage circuit may comprise more than two electronic components. Therefore, the scope of the appended claims should be accorded the broadest interpretation so as to encompass all such modifications and similar arrangements.

For generalization, by introducing N storage capacitors C1~CN to the clock generating circuit, where N is a positive integer, the power consumption of the clock generating circuit is derived as below:

$$P=CL*(VH-VL)^2*f/(N+1) \quad \text{Eq.(4)}$$

Therefore, when introducing N storage capacitors C1~CN to the clock generating circuit, 1/(N+1) power reduction is expected.

Referring back to the embodiment shown in FIG. 5, ideally, V1=(VH−VL)/2. However, when the capacitor C1 is not large enough, voltage drift may occur.

Figure 9A:
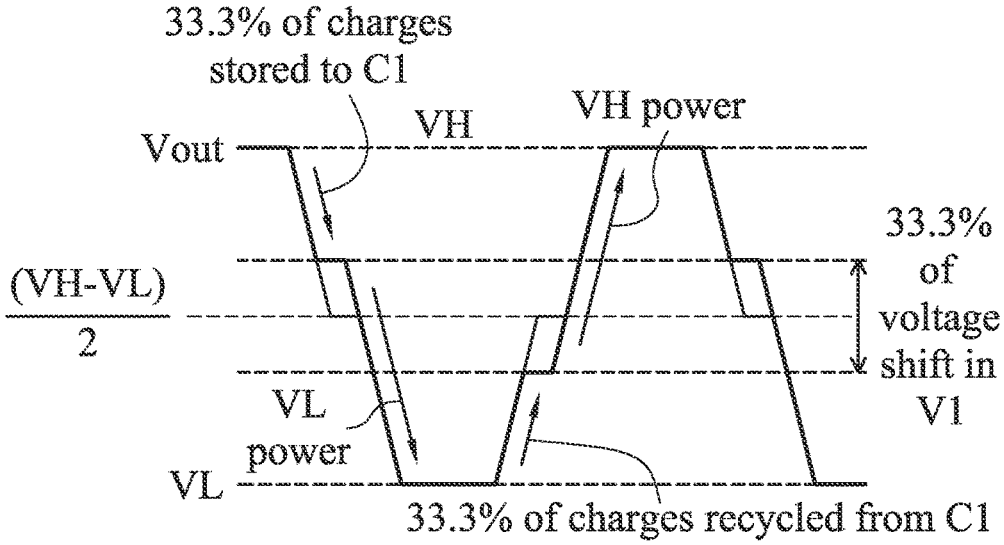
FIG. 9A shows another exemplary waveform of a clock signal generated by the driving circuit as shown in FIG. 5 according to another embodiment of the invention.

FIG. 9A shows another exemplary waveform of a clock signal generated by the driving circuit 500 as shown in FIG. 5 according to another embodiment of the invention. In this embodiment, the capacitance ratio C1/CL=1. As shown in FIG. 9A, only 33.3% of charges is stored to and recycled from the capacitor C1. Therefore, there is 33.3% voltage shift in the first target voltage V1 with respect to the ideal voltage (VH−VL)/2.

Figure 9B:
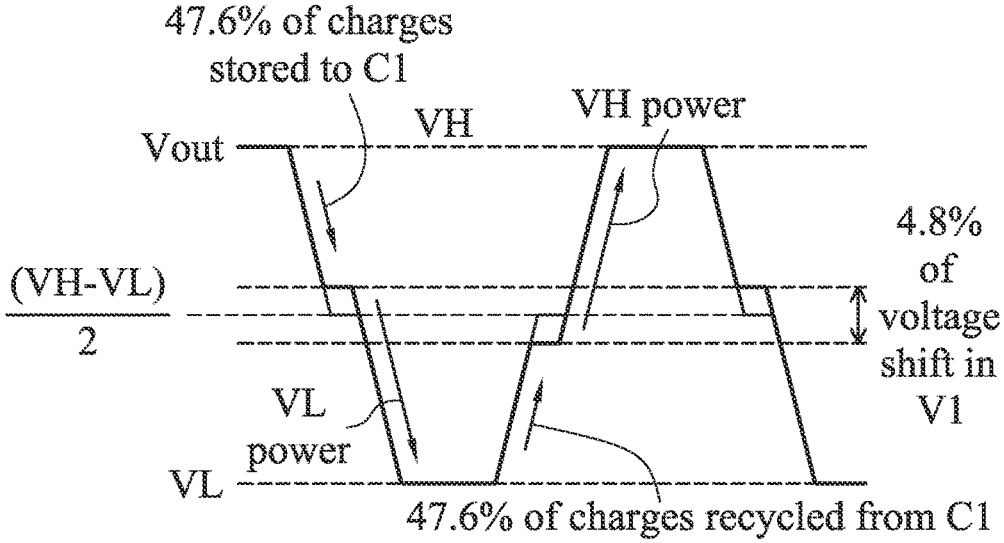
FIG. 9B shows yet another exemplary waveform of a clock signal generated by the driving circuit as shown in FIG. 5 according to yet another embodiment of the invention.

FIG. 9B shows yet another exemplary waveform of a clock signal generated by the driving circuit 500 as shown in FIG. 5 according to yet another embodiment of the invention. In this embodiment, the capacitance ratio C1/CL=10. As shown in FIG. 9B, 47.6% of charges is stored to and recycled from the capacitor C1. Therefore, there is 4.8% voltage shift in the first target voltage V1 with respect to the ideal voltage (VH−VL)/2.

Therefore, in the embodiments of the invention, large storage capacitance is preferable for achieving optimum power reduction. However, large storage capacitance may also cause the rising time of the voltage at a corresponding node (for example, the node N1) to achieve the corresponding target voltage (for example, the first target voltage V1) to increase. Therefore, in the following embodiments of the invention, some other electronic components are further introduced to reduce the rising time of the corresponding voltage(s).

Figure 10:
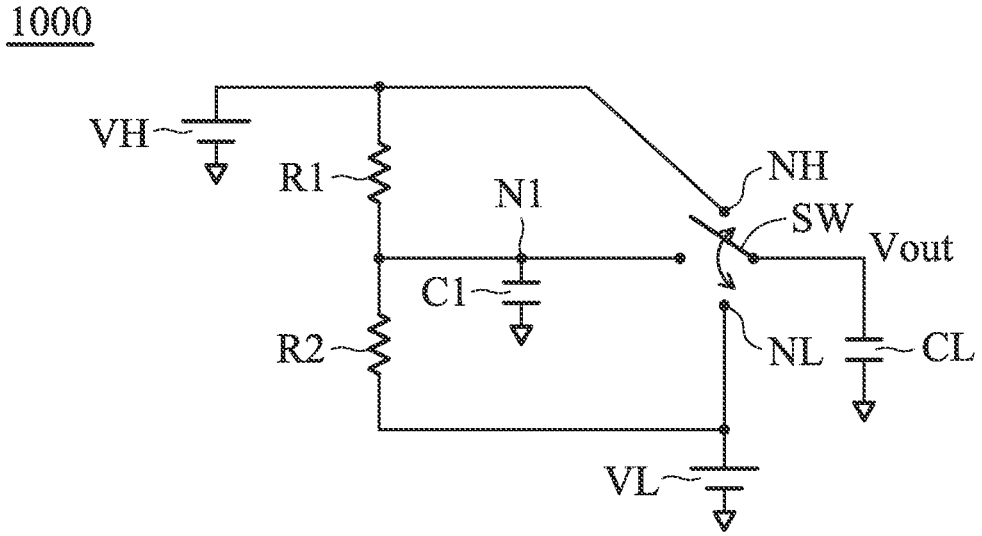
FIG. 10 shows a circuit diagram of yet another exemplary driving circuit according to yet another embodiment of the invention.

FIG. 10 shows a circuit diagram of yet another exemplary driving circuit according to yet another embodiment of the invention. In this embodiment, most of the elements comprised in the driving circuit 1000 and the corresponding control scheme are the same as those in the driving circuit 500 and the corresponding control scheme shown in FIG. 5. The only difference between the driving circuit 500 and the driving circuit 1000 is that the driving circuit 1000 further comprises resistors R1 and R2 coupled in serial between the high voltage node NH and low voltage node NL. The resistors R1 and R2 are configured to reduce the rising time of the voltage at the node N1, which is the time it takes to reach the first target voltage. A connection node of the resistors R1 and R2 is coupled to the node N1. It is preferable that resistors R1 and R2 have equal resistance.

Figure 11:
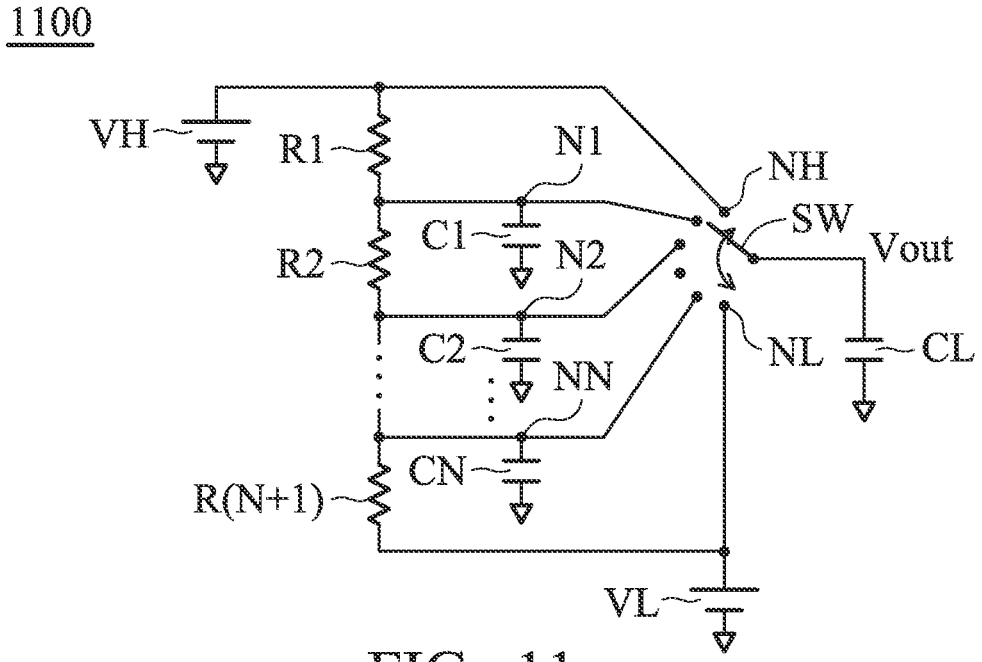
FIG. 11 shows a circuit diagram of still another exemplary driving circuit according to still another embodiment of the invention.

FIG. 11 shows a circuit diagram of still another exemplary driving circuit according to still another embodiment of the invention. In this embodiment, the concept of introducing the resistors to reduce the rising time of the corresponding voltage(s) is applied to the general case of introducing N storage capacitors C1~CN, where N is a positive integer. The driving circuit 1100 comprises (N+1) resistors R1~R(N+1) coupled in serial between the high voltage node NH and low voltage node NL. The resistors R1 and R2 are configured to reduce the rising time of the voltage at the node N1, which is the time it takes to reach the first target voltage. The resistors R2 and R3 are configured to reduce the rising time of the voltage at the node N2, which is the time it takes to reach the second target voltage. The resistors R(N) and R(N+1) are configured to reduce the rising time of the voltage at the node NN, which is the time it takes to reach the $N^{th}$ target voltage, and so on. A connection node of the resistors R1 and R2 is coupled to the node N1, a connection node of the resistors R2 and R3 is coupled to the node N2, a connection node of the resistors R(N) and R(N+1) is coupled to the node NN, and so on. It is preferable that the resistors R1~R(N+1) have equal resistance.

Besides the resistors, a plurality of diodes may also be introduced to reduce the rising time of the corresponding voltage(s).

Figure 12:
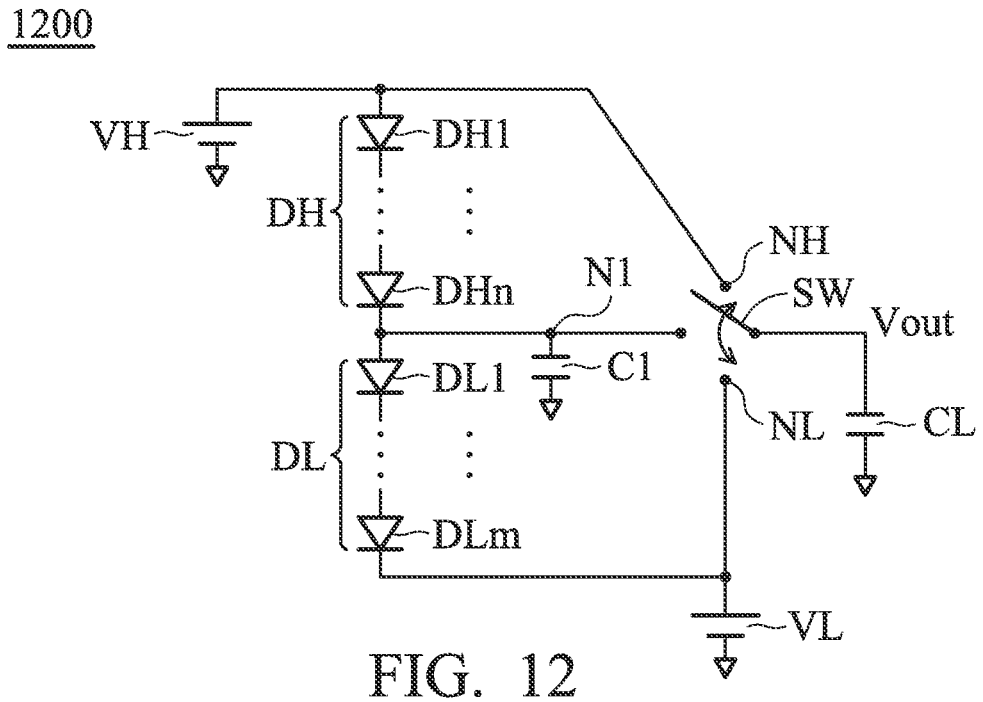
FIG. 12 shows a circuit diagram of still another exemplary driving circuit according to still another embodiment of the invention.

FIG. 12 shows a circuit diagram of still another exemplary driving circuit according to still another embodiment of the invention. In this embodiment, most of the elements comprised in the driving circuit 1200 and the corresponding control scheme are the same as the driving circuit 500 and the corresponding control scheme shown in FIG. 5. The only difference between the driving circuit 500 and the driving circuit 1200 is in that the driving circuit 1200 further comprises one or more first diodes (the DH diodes) DH1~DHn and one or more second diodes (the DL diodes) DL1~DLm coupled in serial between the high voltage node NH and low voltage node NL, where n and m are positive integers. The first diodes DH1~DHn and second diodes DL1~DLm are configured to reduce a rising time of a voltage at the node N1 to reach the first target voltage. The connection node of the first diodes DH1~DHn and second diodes DL1~DLm is coupled to the node N1.

Figure 13:
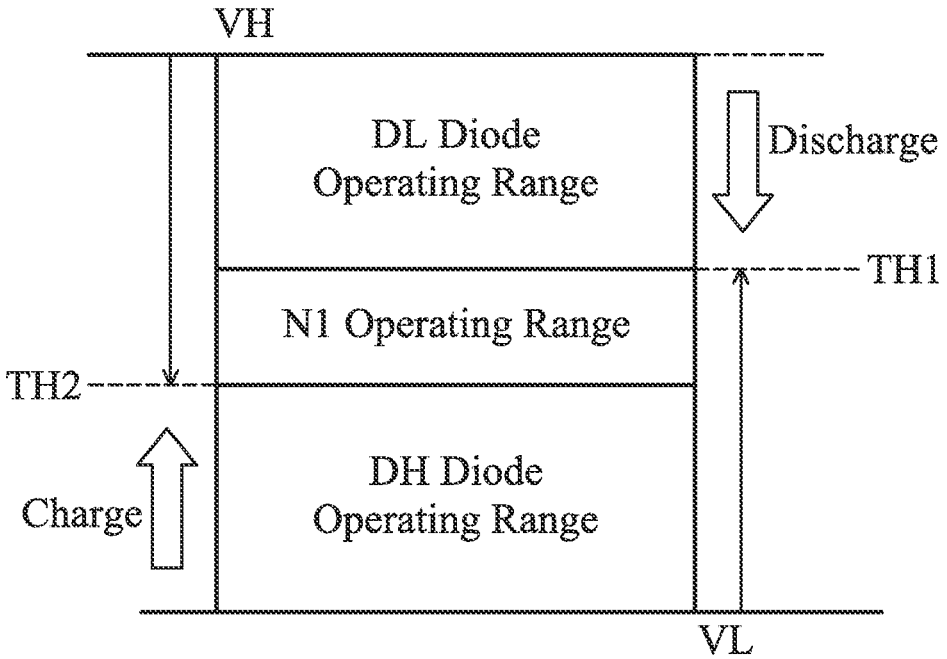
FIG. 13 is an exemplary voltage diagram showing the concept of stabilizing the voltage at the node N1 and reducing the rising time of the voltage at the node N1 to reach the first target voltage according to an embodiment of the invention.

FIG. 13 is an exemplary voltage diagram showing the concept of stabilizing the voltage at the node N1 and reducing the rising time for the voltage at the node N1 to reach the first target voltage according to an embodiment of the invention. When the voltage at the node N1 rises above the upper limit TH1, the second diodes (the DL diodes) DL1~DLm are turned on to discharge the voltage at the node N1. On the other hand, when the voltage at the node N1 falls below the lower limit TH2, the first diodes (the DH diodes) DH1~DHn are turned on to charge the voltage at the node N1. In this manner, the voltage at the node N1 is quickly stabilized in the operating range between the upper limit TH1 and the lower limit TH2. The rising time of the voltage at the node N1 is thus reduced. When the voltage at the node N1 is stabilized in the operating range, all the diodes DH1~DHn and DL1~DLm are turned off and, compared to the embodiments of introducing the resistors as shown in FIGS. 10 and 11, there is no more power consumed by the diodes (since they are all turned off).

Figure 14:
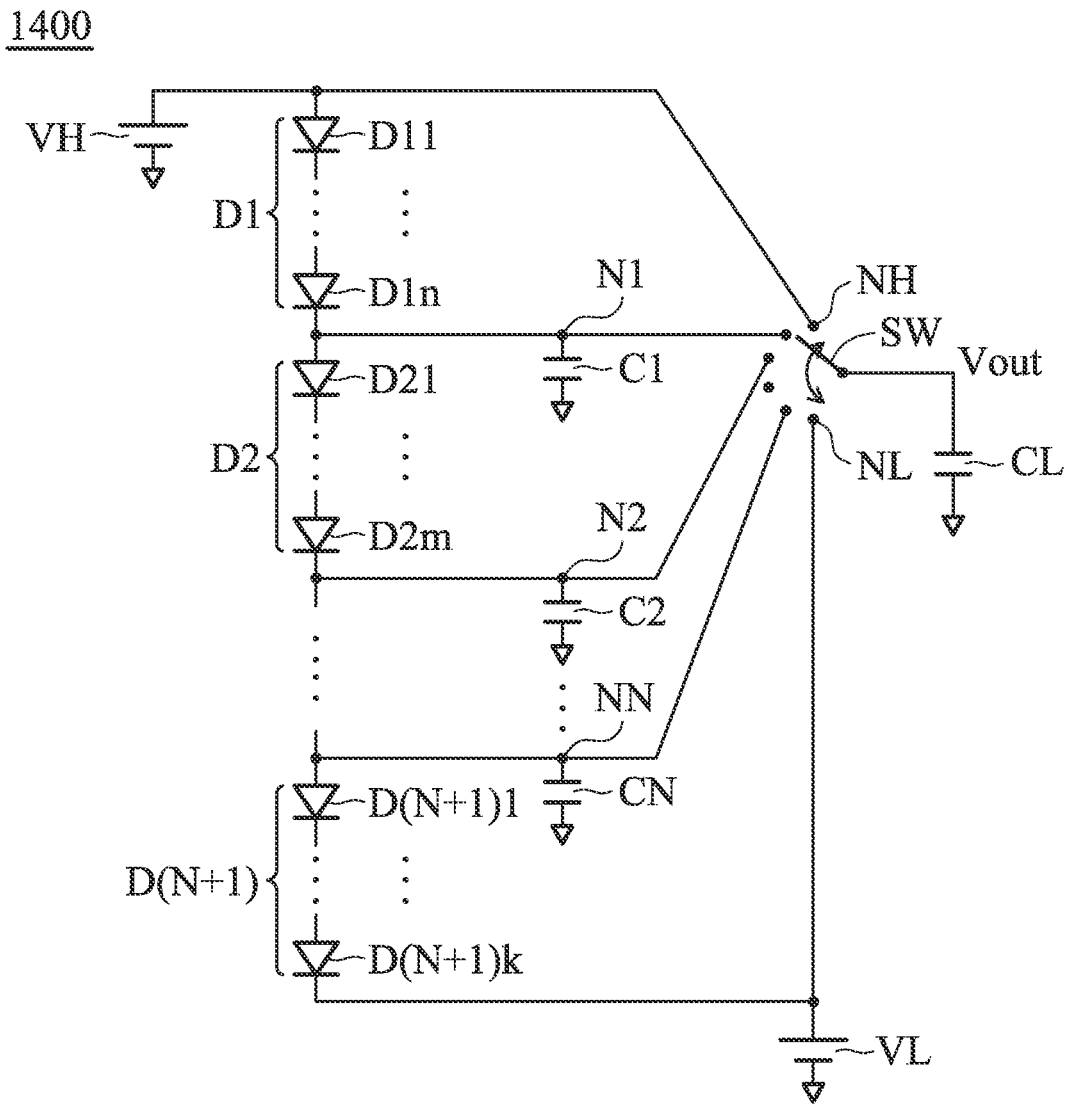
FIG. 14 shows a circuit diagram of still another exemplary driving circuit according to still another embodiment of the invention.

FIG. 14 shows a circuit diagram of still another exemplary driving circuit according to still another embodiment of the invention. In this embodiment, the concept of introducing the diodes to reduce the rising time of the corresponding voltage(s) is applied to the general case of introducing N storage capacitors C1~CN, where N is a positive integer. The driving circuit 1400 comprises (N+1) groups of diodes D1~D(N+1) coupled in serial between the high voltage node NH and low voltage node NL. The groups of diodes D1 and D2 are configured to reduce a rising time of a voltage at the node N1 to reach the first target voltage, the groups of diodes D2 and D3 are configured to reduce a rising time of a voltage at the node N2 to reach the second target voltage, the groups of diodes D(N) and D(N+1) are configured to reduce a rising time of a voltage at the node NN to reach the $N^{th}$ target voltage, and so on. A connection node of the groups of diodes D1 and D2 is coupled to the node N1, a connection node of the groups of diodes D2 and D3 is coupled to the node N2, a connection node of the groups of diodes D(N) and D(N+1) is coupled to the node NN, and so on.

According to an embodiment of the invention, the number of diode(s) in each group (e.g. DH and DL, or D1~D(N+1) may be the same or different, depending on the threshold voltage of the diodes (e.g. the diodes DH1~DHn and DL1~DLm or the diodes D11~D1*n*, D21~D2*m*, . . . D(N+1)1~D(N+1)k, where k is a positive integer), the system high voltage VH, the system low voltage VL, and the required operating range of the corresponding voltage (e.g. the operating range between the upper limit TH1 and the lower limit TH2). For example, as the threshold voltage of the diode increases, the number of diodes introduced can be reduced. In addition, the threshold voltage of each diode can be the same or different, and the invention should not be limited to any specific case.

According to an embodiment of the invention, the diodes and resistors introduced to reduce the rising time of the corresponding voltage can be configured inside of the controller chip 140 or configured on the FPC 102, and the invention should not be limited to any specific way of implementation.

Figure 15:
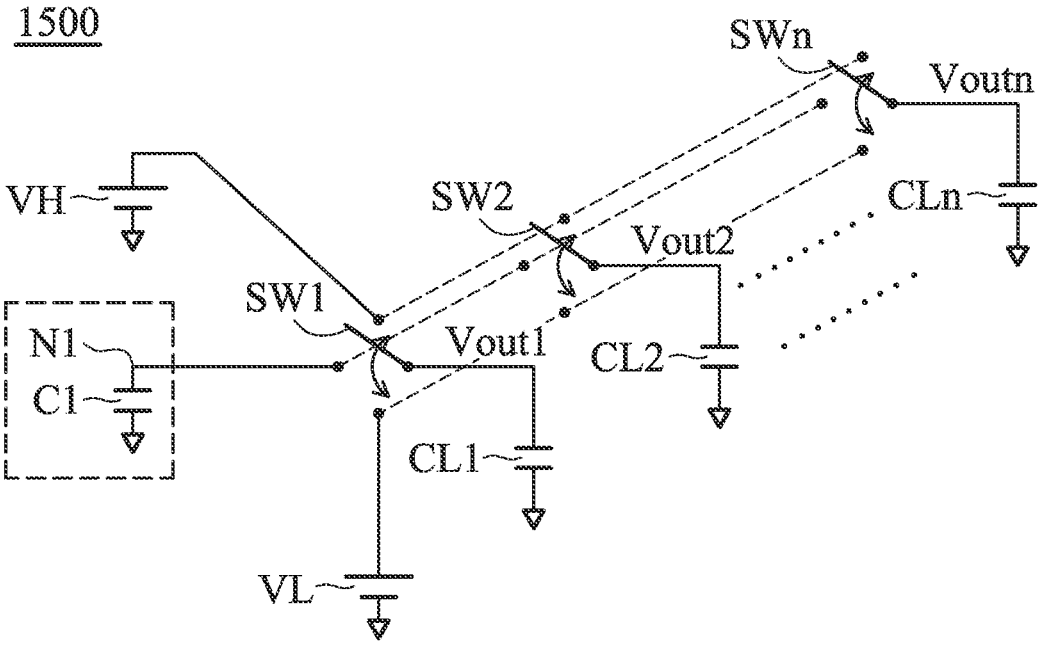
FIG. 15 shows an exemplary circuit diagram of a driving circuit comprising multiple clock generating circuits according to an embodiment of the invention.

FIG. 15 shows an exemplary circuit diagram of a driving circuit comprising multiple clock generating circuits according to an embodiment of the invention. In the embodiment, in the driving circuit 1500, the voltage sources for providing the system high voltage VH and the system low voltage VL and the storage circuit (for example, comprising the capacitor C1) can be shared by multiple clock generating circuits for generating the corresponding clock signals at the corresponding output nodes Vout1·Voutn. The switches SW1·SWn of the multiple clock generating circuits can be independently controlled by the timing controller or other control circuits. Each capacitive loading CL1·CLn represents the loading of the device receiving the corresponding clock signal. For example, the capacitive loading CL1 may represent the capacitive loading of a gate driver, the capacitive loading CL2 may represent a source de-multiplexer, and so on.

Note that the concept of sharing the electronic components among multiple clock generating circuits as illustrated in FIG. 15 may also be applied to a variety of embodiments as illustrated above. For example, for the general case of introducing N storage capacitors C1~CN, the N storage capacitors C1~CN may also be shared as the capacitor C1 shown in FIG. 15. In another example, for the case in which resistors are introduced to reduce the rising time of the corresponding voltage(s) as shown in FIG. 10 and FIG. 11, the resistors may also be shared among multiple clock generating circuits as the capacitor C1 shown in FIG. 15. For yet another example, for the case in which diodes are introduced to reduce the rising time of the corresponding voltage(s) as shown in FIG. 12 and FIG. 14, the diodes may also be shared among multiple clock generating circuits as the capacitor C1 shown in FIG. 15.

Figure 16A:
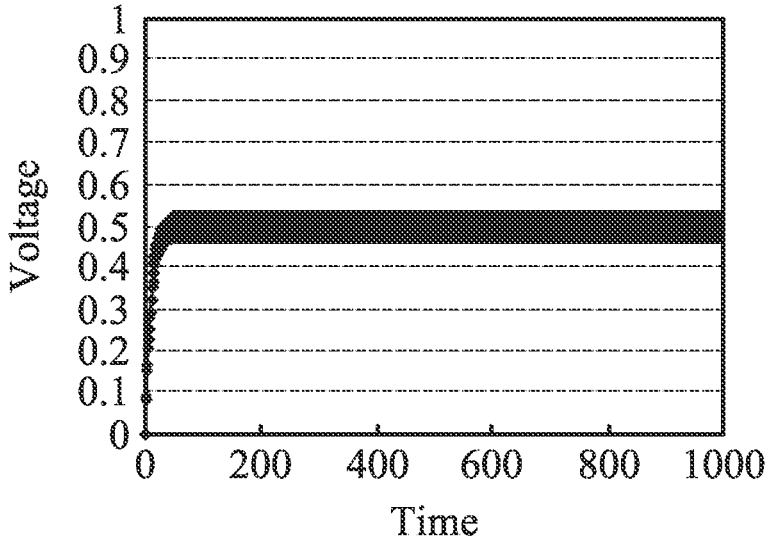
FIG. 16A~FIG. 16C show the exemplary waveforms of the simulated voltage at the node N1 based on different embodiments.
Figure 16B:
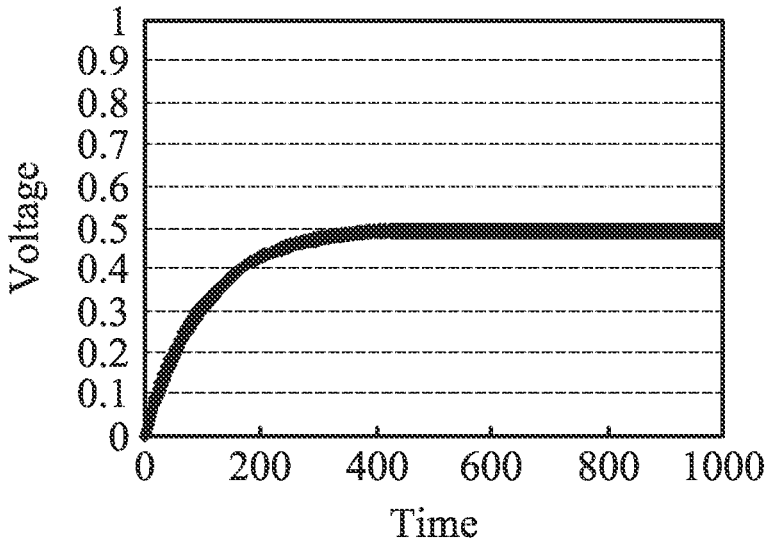
Figure 16C:
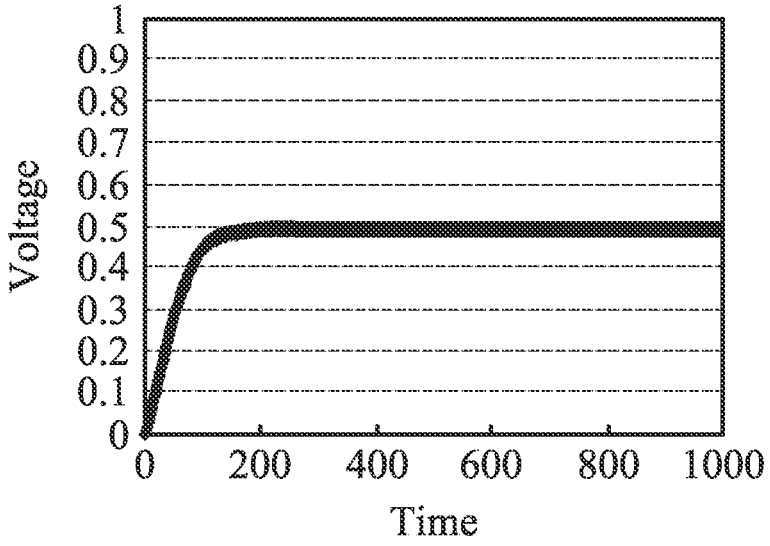

FIG. 16A~FIG. 16C show the exemplary waveforms of the simulated voltage at the node N1 based on different embodiments. In FIG. 16A, the voltage at the node N1 is simulated based on circuit diagram shown in FIG. 5, where VH=1V, VL=0V, initial voltage at the node N1=0V, and the capacitance ratio C1/CL=10. In FIG. 16B, the voltage at the node N1 is simulated based on circuit diagram shown in FIG. 5, where VH=1V, VL=0V, initial voltage at the node N1=0V, and the capacitance ratio C1/CL=100. In FIG. 16C, the voltage at the node N1 is simulated based on circuit diagram shown in FIG. 10, where VH=1V, VL=0V, initial voltage at the node N1=0V, and the capacitance ratio C1/CL=100. Comparing FIG. 16A with FIG. 16B, it can be understood that the voltage shift decreases as the capacitance ratio increases. Comparing FIG. 16B with FIG. 16C, it can be understood that the rising time of the voltage is greatly reduced when introducing resistors. Note that the rising time of the voltage is also greatly reduced when introducing diodes, and the simulation result obtained based on the circuit diagram shown in FIG. 12 is similar to the simulation result as shown in FIG. 16C.

Figure 17A:
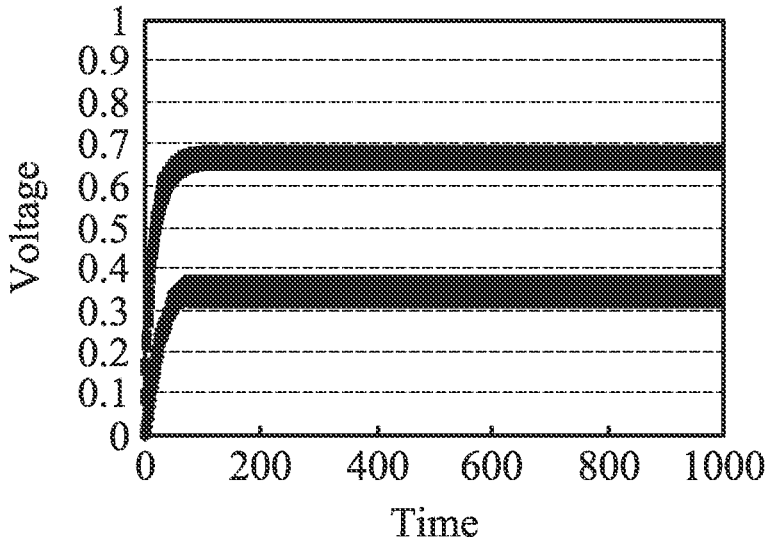
FIG. 17A~FIG. 17C show the exemplary waveforms of the simulated voltages at the nodes N1 and N2 based on different embodiments.
Figure 17B:
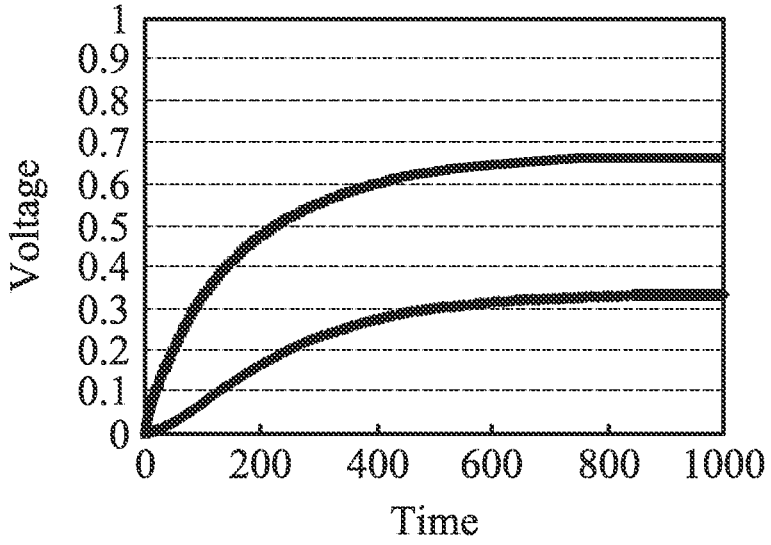
Figure 17C:
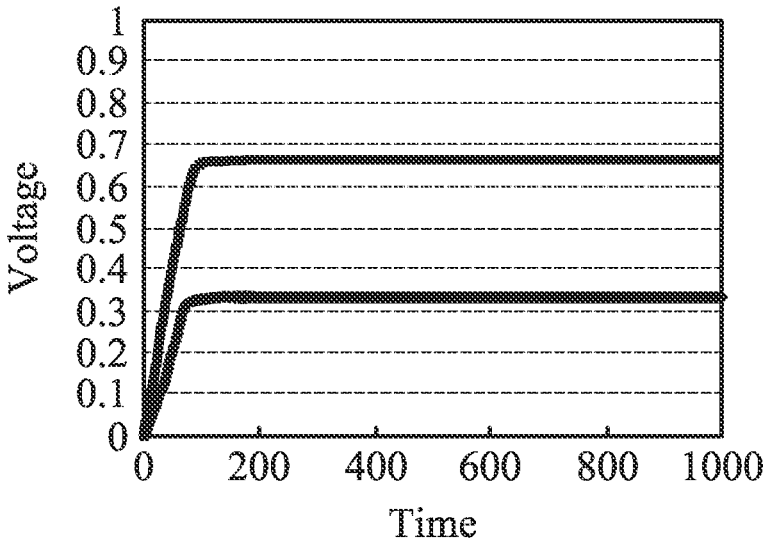

FIG. 17A~FIG. 17C show the exemplary waveforms of the simulated voltages at the nodes N1 and N2 based on different embodiments. In FIG. 17A, the voltage at the node N1 is simulated based on circuit diagram shown in FIG. 7, where VH=1V, VL=0V, initial voltage at the node N1=0V, initial voltage at the node N2=0V, and the capacitance ratio C1/CL=C2/CL=10. In FIG. 17B, the voltage at the node N1 is simulated based on circuit diagram shown in FIG. 7, where VH=1V, VL=0V, initial voltage at the node N1=0V, initial voltage at the node N2=0V, and the capacitance ratio C1/CL=C2/CL=100. In FIG. 17C, the voltage at the node N1 is simulated based on the circuit diagram shown in FIG. 11, where VH=1V, VL=0V, initial voltage at the node N1=0V, initial voltage at the node N2=0V, the capacitance ratio C1/CL=C2/CL=100, and the number of resistors is 3 (that is, N=2). Comparing FIG. 17A with FIG. 17B, it can be understood that the voltage shift decreases as the capacitance ratio increases. Comparing FIG. 17B with FIG. 17C, it can be understood that the rising times of the voltages are greatly reduced when introducing resistors. Note that the rising times of the voltages are also greatly reduced when introducing diodes, and the simulation result obtained based on circuit diagram shown in FIG. 14 when N=2 is similar to the simulation result as shown in FIG. 17C.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A display device, comprising:

a controller chip, comprising a clock generating circuit configured to generate a clock signal;

a storage circuit, coupled to the clock generating circuit and comprising a first electronic component, wherein in a falling edge of the clock signal, a voltage of the clock signal falls in multiple steps from a system high voltage to a first target voltage and then to a system low voltage, and in a rising edge of the clock signal, the voltage of the clock signal rises in multiple steps from the system low voltage to the first target voltage and then to the system high voltage; and at least a first diode and a second diode coupled in serial between a high voltage node for providing the system high voltage and a low voltage node for providing the system low voltage, wherein a first connection node of the first diode and the second diode is coupled to a first node, and wherein the first node is coupled to the first electronic component.

2. The display device as claimed in claim 1, wherein the first electronic component is a capacitor.

3. The display device as claimed in claim 1, wherein the clock generating circuit comprises a switch having one terminal coupled to an output node for outputting the clock signal and another terminal selectively coupled to a plurality of nodes comprising at least the high voltage node for providing the system high voltage, the low voltage node for providing the system low voltage, the first node coupled to the first electronic component.

4. The display device as claimed in claim 1, wherein the storage circuit further comprise a second electronic component, in the falling edge of the clock signal, the voltage of the clock signal falls in multiple steps from the system high voltage to the first target voltage, a second target voltage and then to the system low voltage, and in the rising edge of the clock signal, the voltage of the clock signal rises in multiple steps from the system low voltage to the second target voltage, the first target voltage and then to the system high voltage.

5. The display device as claimed in claim 4, wherein the clock generating circuit comprises a switch having one terminal coupled to an output node for outputting the clock signal and another terminal selectively coupled to a plurality of nodes comprising at least the high voltage node for providing the system high voltage, the low voltage node for providing the system low voltage, the first node coupled to the first electronic component and a second node coupled to the second electronic component.

6. The display device as claimed in claim 4, wherein the first electronic component and the second electronic component are capacitors.

7. The display device as claimed in claim 4, further comprising a third diode, wherein the first diode, the second diode and the third diode are coupled in serial between the high voltage node and the low voltage node, wherein a second connection node of the second diode and the third diode is coupled to a second node, and wherein the second node is coupled to the second electronic component.

8. A driving circuit, comprising:

a clock generating circuit, configured to generate a clock signal;

a first capacitor, coupled to the clock generating circuit, wherein in a falling edge of the clock signal, a voltage of the clock signal falls in multiple steps from a system high voltage to a first target voltage and then to a system low voltage, and in a rising edge of the clock signal, the voltage of the clock signal rises in multiple steps from the system low voltage to the first target voltage and then to the system high voltage; and at least a first diode and a second diode coupled in serial between a high voltage node for providing the system high voltage and a low voltage node for providing the system low voltage, wherein a first connection node of the first diode and the second diode is coupled to a first node, and wherein the first node is coupled to the first capacitor.

9. The driving circuit as claimed in claim 8, wherein the clock generating circuit comprises a switch having one terminal coupled to an output node for outputting the clock signal and another terminal selectively coupled to a plurality of nodes comprising at least the high voltage node for providing the system high voltage, the low voltage node for providing the system low voltage, the first node coupled to the first capacitor.

10. The driving circuit as claimed in claim 8, wherein in the falling edge of the clock signal, a portion of charges discharged from a capacitive loading are stored to the first capacitor and in the rising edge of the clock signal, the charges stored in the first capacitor are discharged and recycled to charge the capacitive loading.

11. The driving circuit as claimed in claim 8, further comprising a second capacitor, in the falling edge of the clock signal, the voltage of the clock signal falls in multiple steps from the system high voltage to the first target voltage, a second target voltage and then to the system low voltage, and in the rising edge of the clock signal, the voltage of the clock signal rises in multiple steps from the system low voltage to the second target voltage, the first target voltage and then to the system high voltage.

12. The driving circuit as claimed in claim 11, wherein the clock generating circuit comprises a switch having one terminal coupled to an output node for outputting the clock signal and another terminal selectively coupled to a plurality of nodes comprising at least the high voltage node for providing the system high voltage, the low voltage node for providing the system low voltage, the first node coupled to the first capacitor and a second node coupled to the second capacitor.

13. The driving circuit as claimed in claim 11, wherein in the falling edge of the clock signal, a portion of charges discharged from a capacitive loading are stored to the first capacitor and another portion of charges discharged from the capacitive loading are stored to the second capacitor, and in the rising edge of the clock signal, the charges stored in the first capacitor and the charges stored in the second capacitor are discharged and recycled to charge the capacitive loading.

14. The driving circuit as claimed in claim 11, further comprising a third diode, wherein the first diode, the second diode and the third diode are coupled in serial between the high voltage node and the low voltage node, wherein second connection node of the second diode and the third diode is coupled to a second node, and wherein the second node is coupled to the second capacitor.

* * * * *